US005504996A

United States Patent [19]

Popovits et al.

[11] Patent Number: 5,504,996

[45] Date of Patent: Apr. 9, 1996

[54] METHOD OF CONVERTING TRACTION MOTOR SUSPENSION SYSTEM

[75] Inventors: Stephen Popovits; Krzysztof Stasiak; Edward Pauch; Adrian Van de Graaf, all of Winnipeg, Canada

[73] Assignee: CAE Vanguard, Ltd., Canada

[21] Appl. No.: 259,188

[22] Filed: Jun. 13, 1994

[51] Int. Cl.[6] ..... B23P 11/00

[52] U.S. Cl. ..... 29/898.07; 29/898.01; 29/898.08; 29/401.1

[58] Field of Search ..... 29/898.01, 898.07, 29/898.08, 898.09, 401.1; 384/459; 105/136, 218.1, 220, 221.1

[56] References Cited

U.S. PATENT DOCUMENTS 4,278,028 7/1981 Eichinger et al. ..... 105/136
4,398,468 8/1983 Bell et al. ..... 105/136
5,129,156 7/1992 Walker ..... 29/898.09

*Primary Examiner*—S. Thomas Hughes
*Attorney, Agent, or Firm*—Dorsey & Whitney

[57] ABSTRACT

Locomotive traction motors have conventionally been used in North America with sleeve-type friction bearing suspension systems. Roller bearing suspension systems have been gaining acceptance in North America. There is no known method of converting the sleeve-type systems to roller bearing systems. This problem is overcome by a method in which the bearing caps covering the sleeve bearings, the sleeve bearings and the shaft are removed; recesses are formed in the bearing caps and in the traction motor housing proximate the ends of the traction motor for receiving roller bearing housings at each end of the traction motor housing; installing the roller bearing housings on an axle and in said recesses in the bearing caps; mounting a generally U-shaped cover between the bearing caps, the U-shaped cover and bearing caps surrounding the central portion of the axle; and connecting the bearing caps to the traction housing.

5 Claims, 9 Drawing Sheets

METHOD OF CONVERTING TRACTION MOTOR SUSPENSION SYSTEM

TECHNICAL FIELD

This invention relates to a method of converting a locomotive traction motor sleeve-type bearing suspension system to a roller bearing system.

BACKGROUND OF THE INVENTION

Locomotive traction motors have been manufactured in North America since the 1950's. Roller bearings have been used with such motors for locating a drive axle in relation to the traction motor and for maintaining spacing for the drive gears. Examples of roller bearing systems are disclosed by U.S. Pat. No. 2,742,864, issued to R. B. Enyart on Apr. 24, 1956, and U.S. Pat. No. 3,138,115, issued to M. N. Waite on Jun. 23, 1964. The use of roller bearings has been restricted to Europe where such bearings gained acceptance in the 1960's. Roller bearings have only recently been adopted in Canada. Early units experienced failures, but the problems have been solved and current units appear to be operating in a satisfactory manner.

To date, no successful method has been developed to convert the old style sleeve-type bearing suspension system to the new style roller bearing system. One proposal is to replace the entire traction motor and bearings with new units, or the replacement of the motor housing.

The object of the present invention is to solve the conversion problem by providing a relatively simple method of converting a locomotive traction motor sleeve-type bearing suspension system to a roller bearing system, the method requiring minimum modification to existing equipment and therefor minimum cost.

SUMMARY OF THE INVENTION

Accordingly, the present invention relates to a method converting a locomotive traction motor sleeve-type bearing suspension system to a roller bearing system wherein the bearing system includes bearing caps covering sleeve bearings mounted in a traction motor housing and rotatably supporting a conventional wheel axle the method comprising the steps of (a) removing the bearings, bearing caps and the axle; (b) forming recesses in the bearing caps and in the traction motor housing proximate the ends of the traction motor for receiving roller bearing housings at each end of said traction motor housing; (c) installing the roller bearing housings on an axle and in said recesses in the bearing caps; (d) mounting a generally U-shaped cover between said bearing housings, said U-shaped cover and said bearing caps surrounding the central portion of the axle; and (e) connecting said bearing caps to said traction motor housing.

BRIEF DESCRIPTION OF THE DRAWINGS

The invention will be described in detail with reference to the accompanying drawings, which illustrate a preferred embodiment of the invention, and wherein.

DETAILED DESCRIPTION

Figure 1:
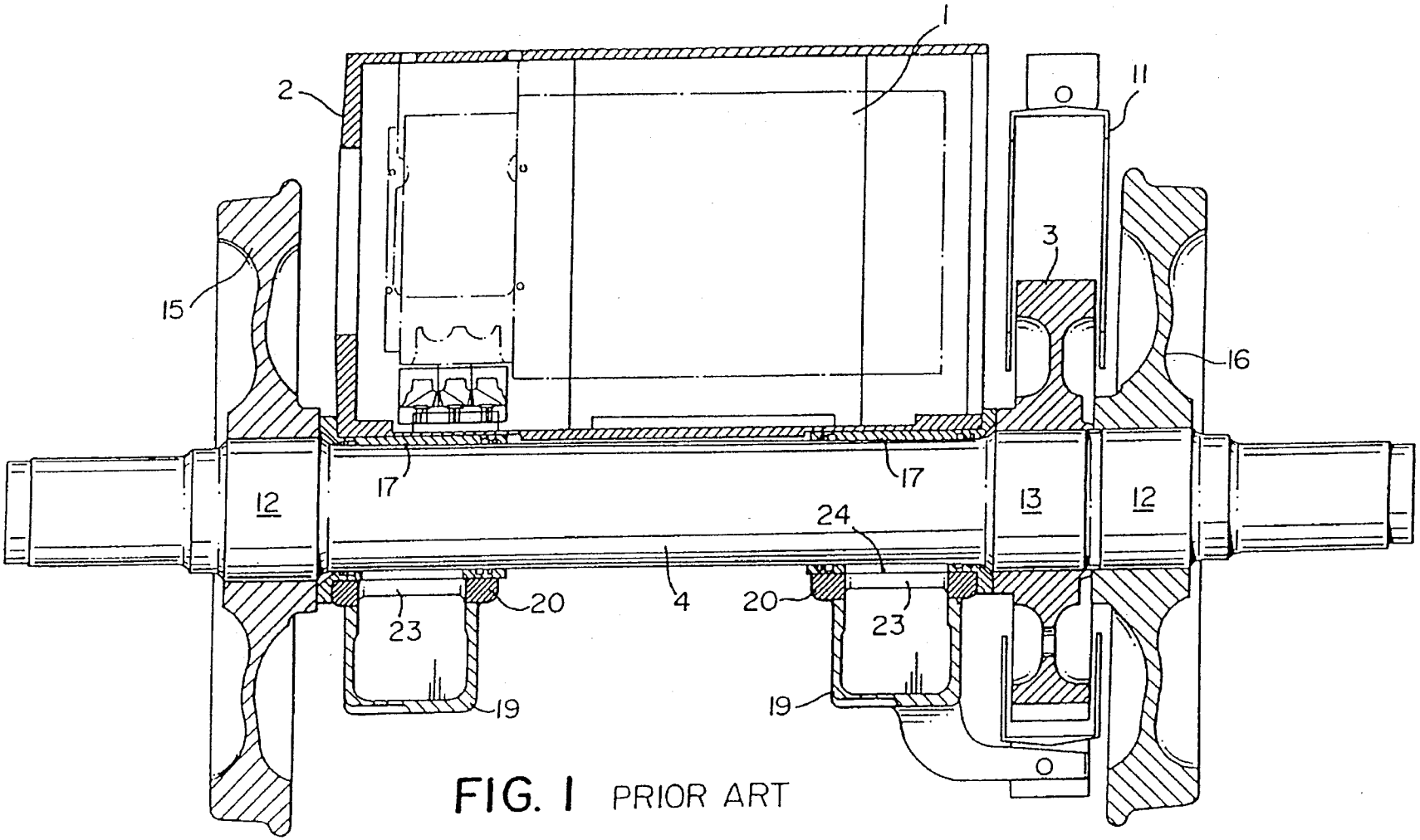
FIG. 1 PRIOR ART
FIG. 1 is a longitudinal sectional view of a locomotive traction motor bearing suspension system in accordance with the prior art.
Figure 2:
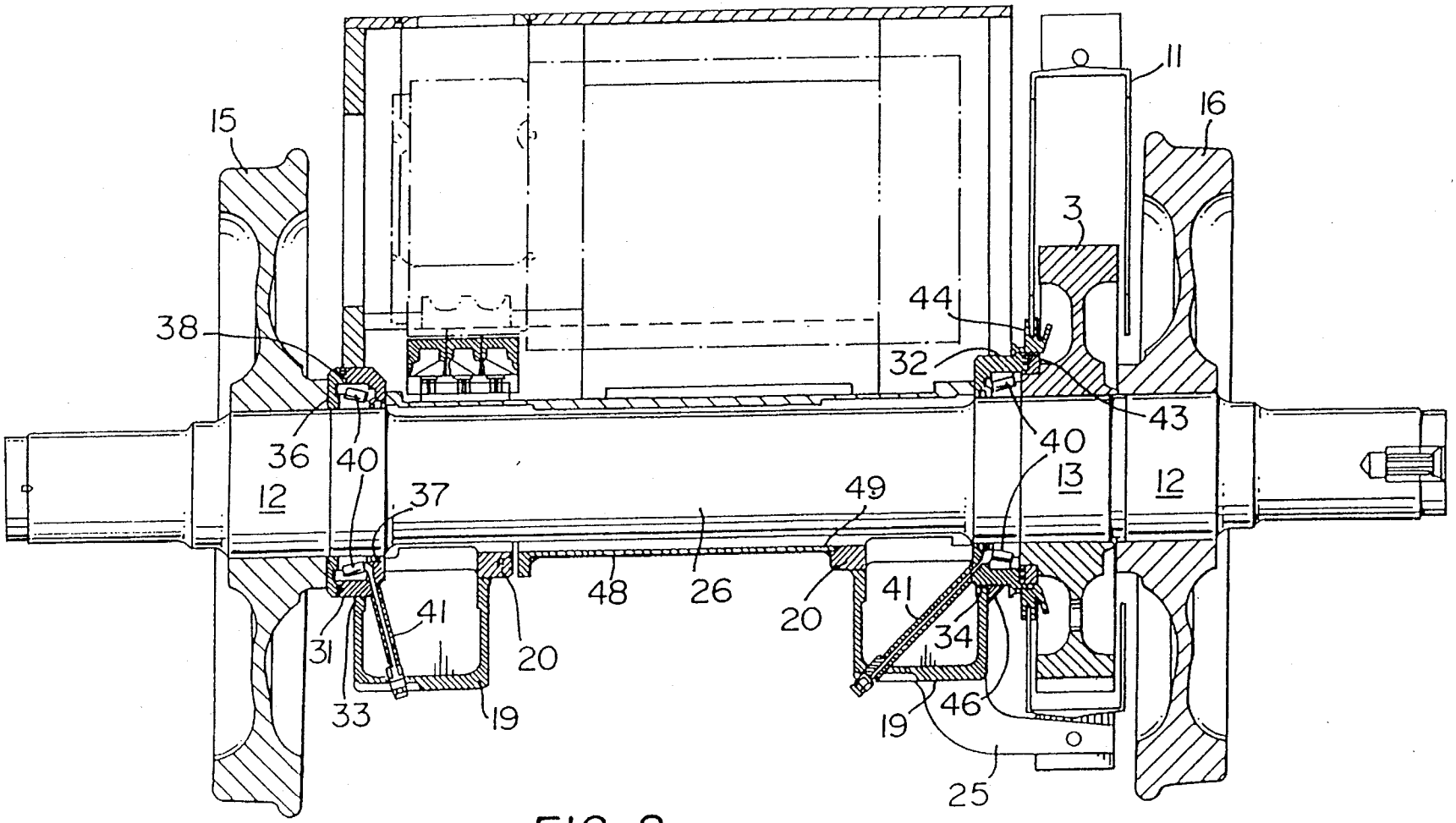
FIG. 2 is a longitudinal sectional view of a roller bearing suspension system following conversion from the system of FIG. 1.
Figure 3:
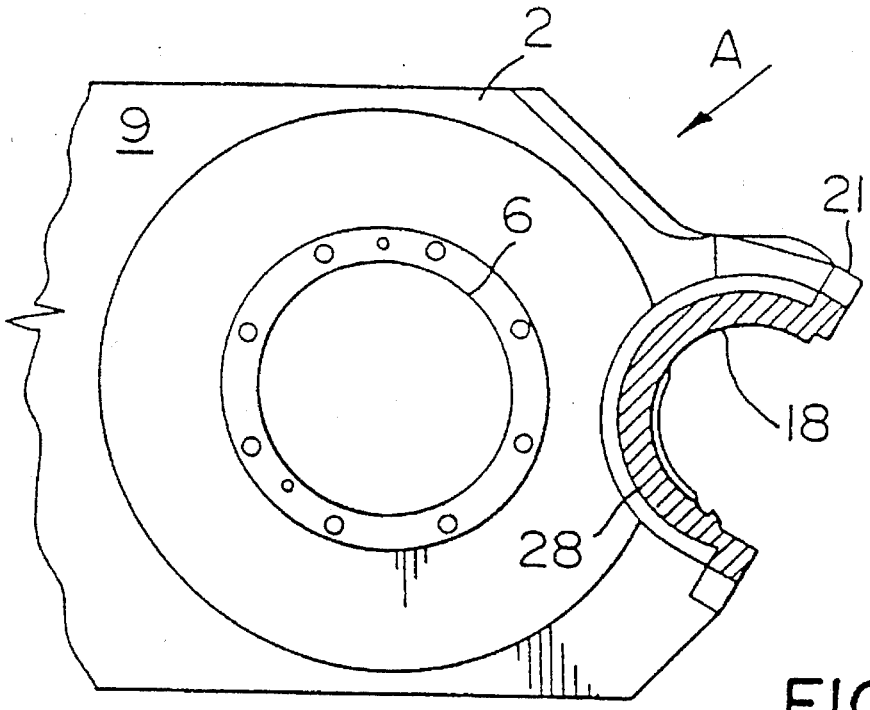
FIGS. 3 and 4 are end views of a portion of a traction motor housing as seen from the left and right, respectively of FIG. 2.
Figure 4:
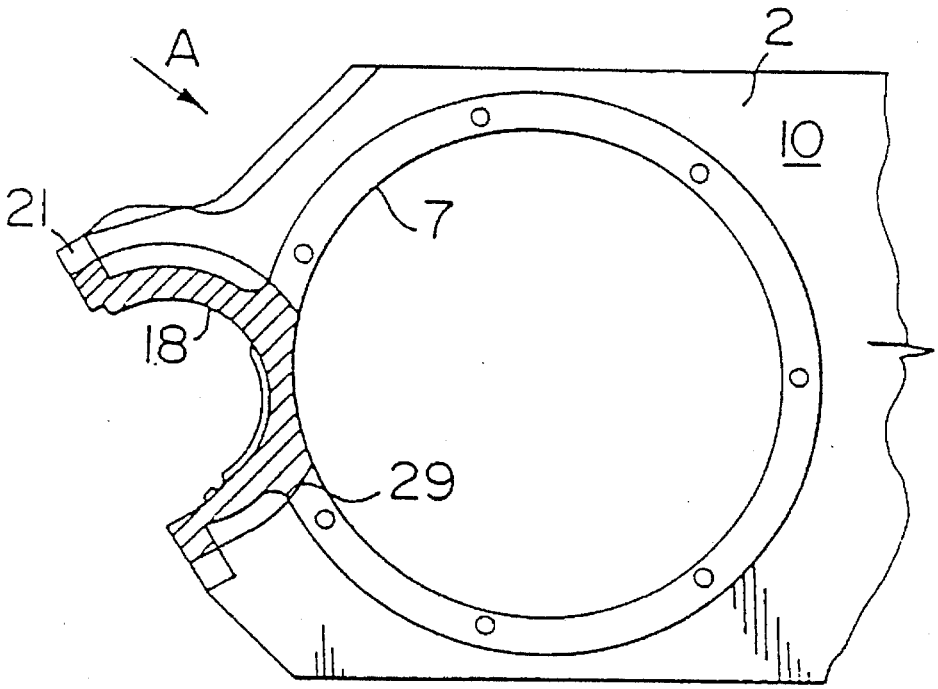
Figure 5:
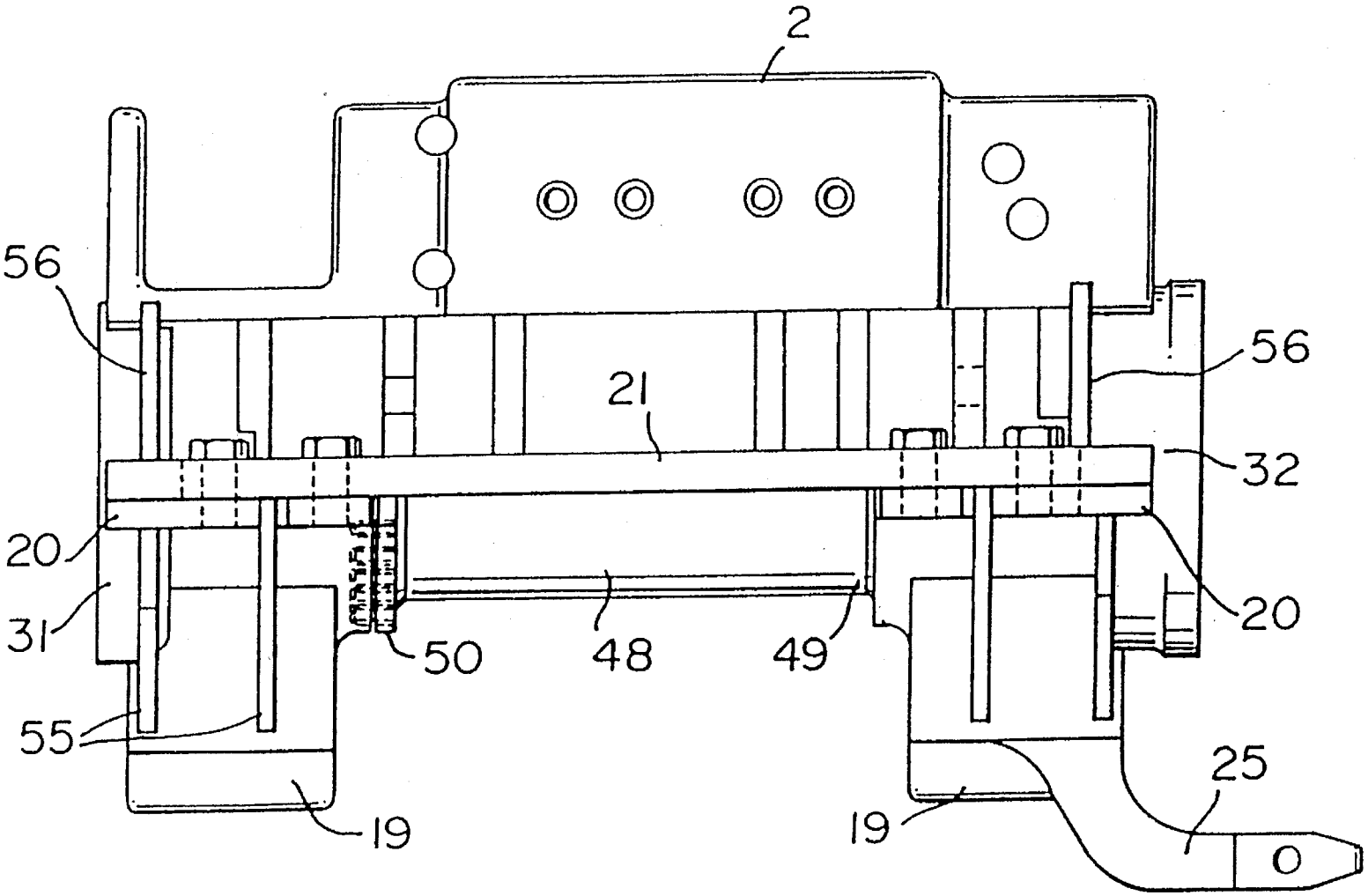
FIG. 5 is a side view of the traction motor housing with bearing housings, bearing caps and a shaft cover mounted thereon as viewed generally in direction A of FIGS. 3 and 4.
Figure 6:
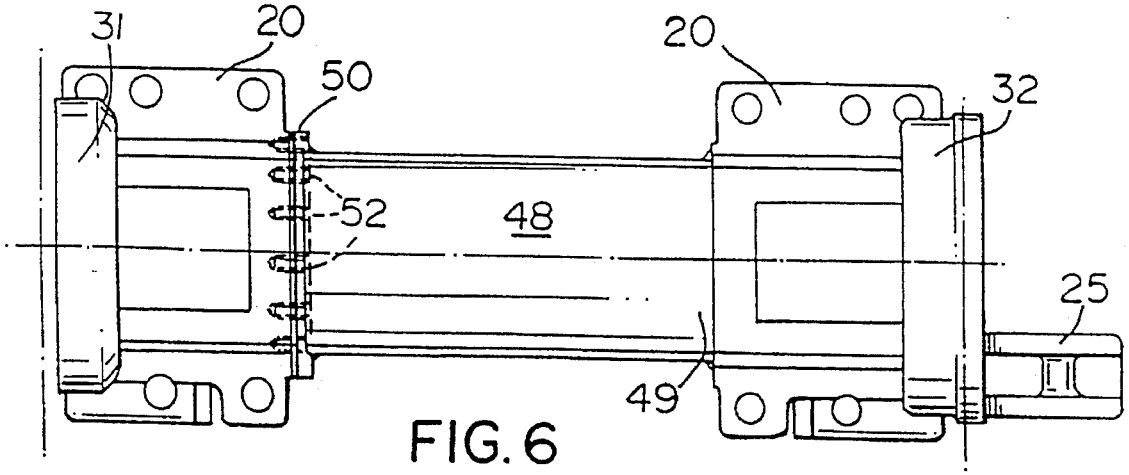
FIG. 6 is a plan view of the bearing housings, bearing caps and shaft cover of FIG. 2, with parts omitted.
Figure 7:
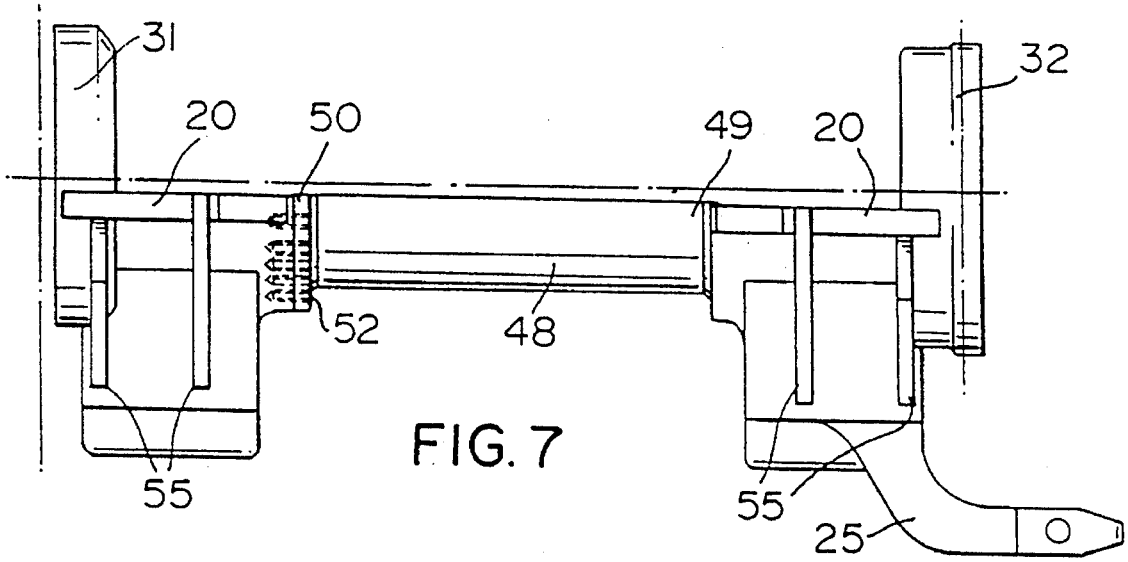
FIG. 7 is a side view of the bearing housings, bearing caps and shaft cover of FIG. 6 with parts omitted.
Figure 8:
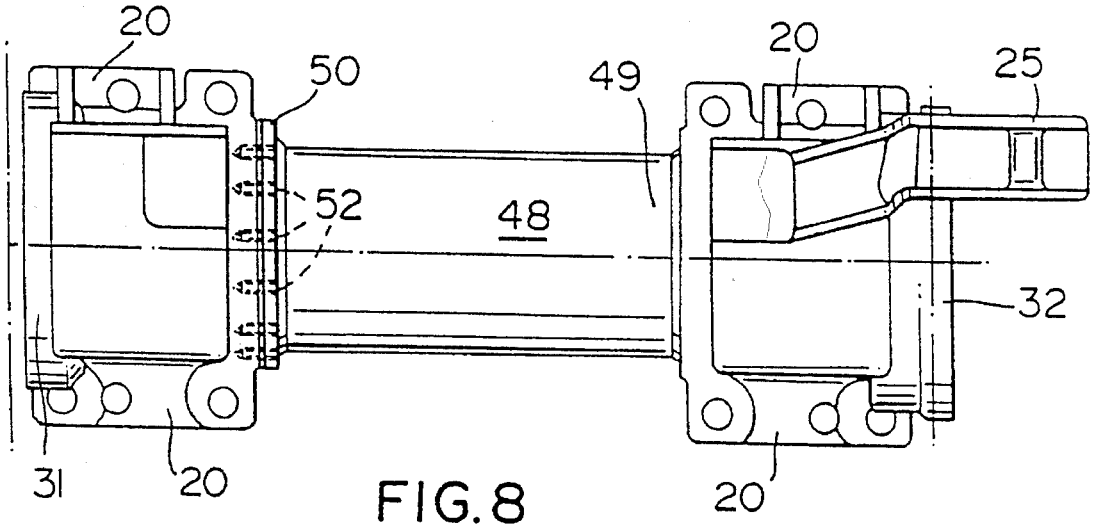
FIG. 8 is a bottom view of the bearing housings, bearing caps and shaft cover of FIGS. 6 and 7.
Figure 9:
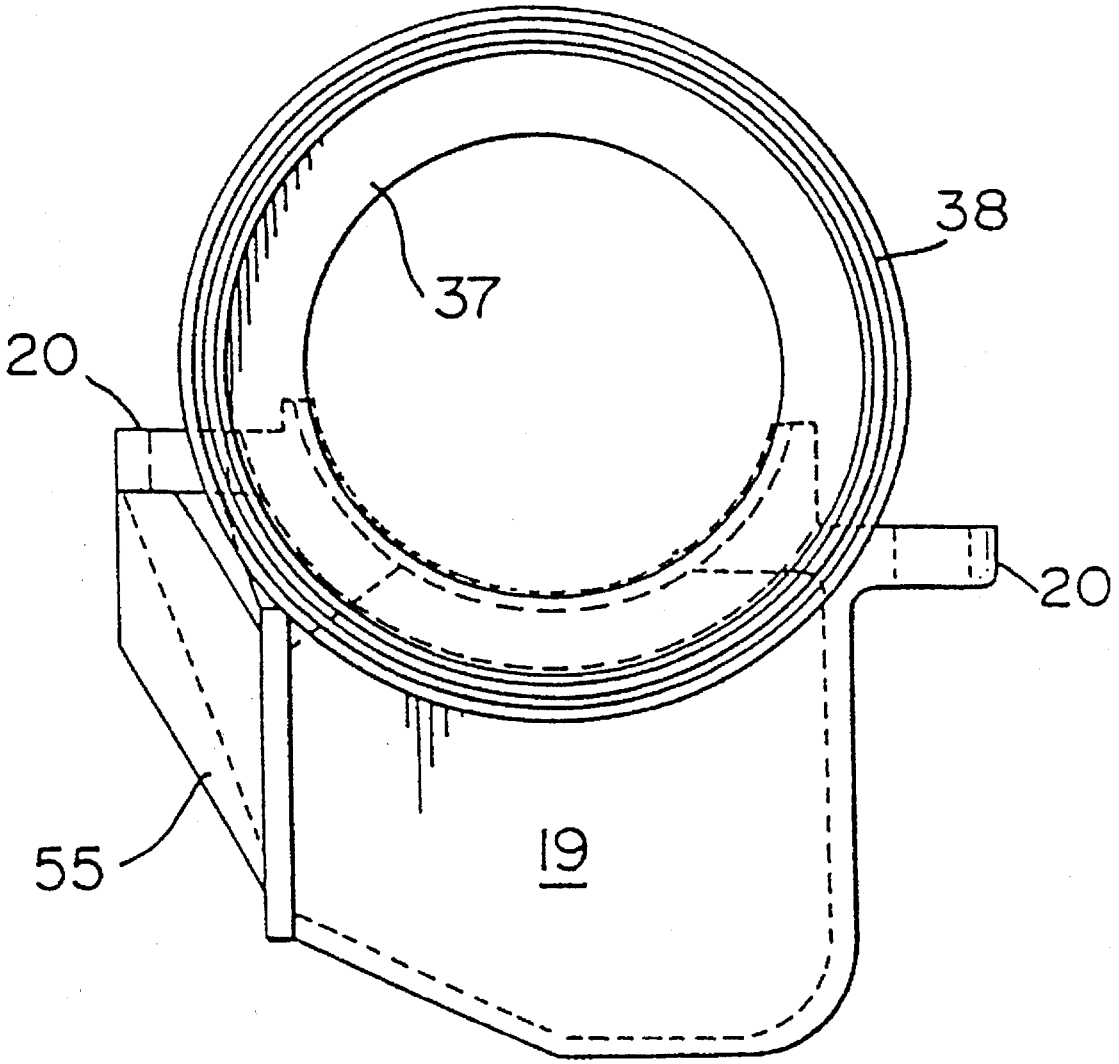
FIG. 9 is an end view of one half of a bearing housing, and a bearing cap as viewed from the left of FIG. 6.
Figure 10:
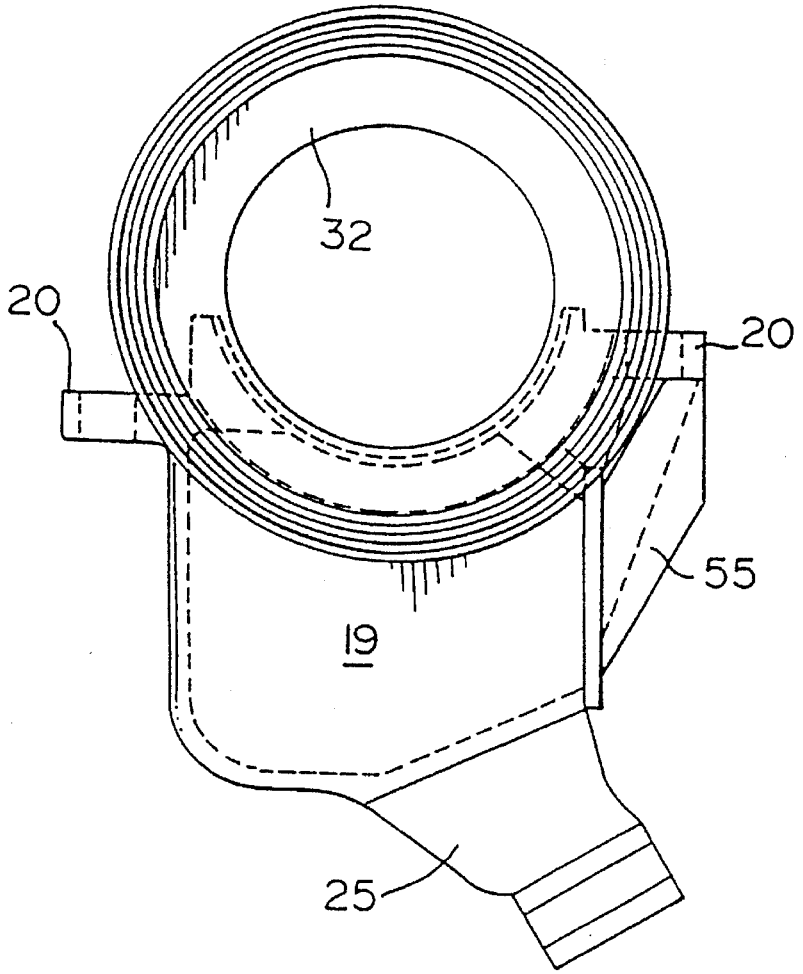
FIG. 10 is an end view of a bearing housing and a bearing cap as viewed from the right respectively of FIG. 6.

With reference to FIG. 1, a conventional traction motor 1 is mounted in a housing 2 for driving a gear 3 mounted on an elongated shaft 4. As best shown in FIGS. 3 to 5, the housing 2, (only a portion of which is shown) includes openings 6 and 7 in the ends 9 and 10, respectively thereof. A cover 11 protects the gear 3. The shaft 4 includes larger diameter portions 12 and 13 which act as seats for the gear 3 and a pair of wheels 15 and 16. A pair of cylindrical, sleeve-type bearings 17 are provided on the shaft 4 permitting rotation thereof. The bearings 17 are mounted in a semicylindrical recess 18 in the housing 2. Oil caps 19 are mounted on each of the bearings 17 for lubricating the shaft 4 and the bearings 17. As best shown in FIGS. 6 to 8, each cap 19 has a thick mounting flange 20 for connecting the cap to flanges 21 (FIGS. 3 to 5) on the housing 2. An opening 23 in the caps 19 is aligned with an opening 24 in the bearing 17 so that oil contacts the shaft 4 and the bearing 17. One of the caps 19 includes an arcuate arm 25, which supports the gear cover 11.

The first step in converting the shaft suspension from the sleeve-type bearing system to a roller bearing system is to remove the oil caps 19 and the bearing 17. The shaft 4 is replaced by another shaft 26, with a longer seat 13. The housing 2 is machined at both ends to form semicircular recesses 28 and 29 at the ends thereof for receiving roller bearing housings 31 and 32. Recesses 33 and 34 are also formed in the oil caps 19 for the same purpose. The bearing housing 31 at one end of the traction motor 1 is a two-piece annular assembly defined by two halves 36 and 37 with a labyrinth seal 38 where the halves are joined. Roller bearing elements 40 are mounted in the housings 31 and 32 for rotatably supporting the shaft 26. Grease tubes 41 are mounted in the oil caps 19 for carrying grease to the bearings. The other bearing housing 32 is a one-piece annulus of L-shaped cross section, the open end thereof being closed by the gear 3. A labyrinth seal 43 is provided between the open end of the housing 32 and a shoulder on one side of the gear 3. An annular gear cover seal 44 is provided between the open end of the housing 32 and the gear cover 11. A reinforcing gusset 46 extends between the oil cap 19 and the bearing housing 32.

Figure 11:
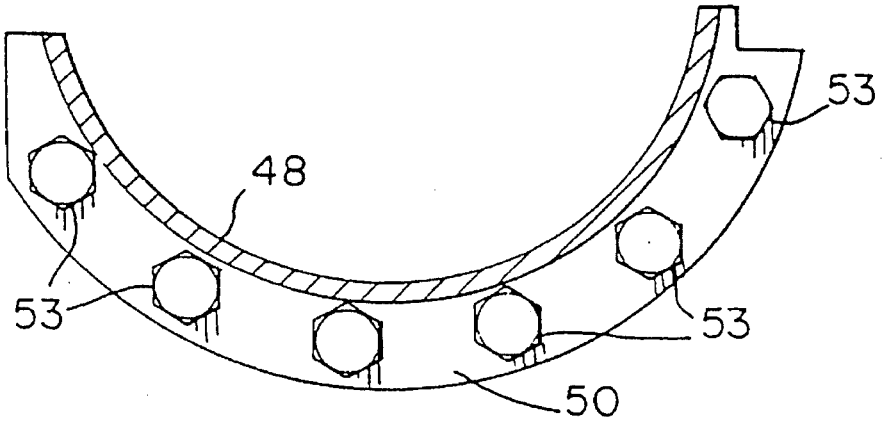
FIG. 11 is a cross section of one end of the shaft cover of FIGS. 6 to 8 illustrating a mounting flange.
Figure 12:
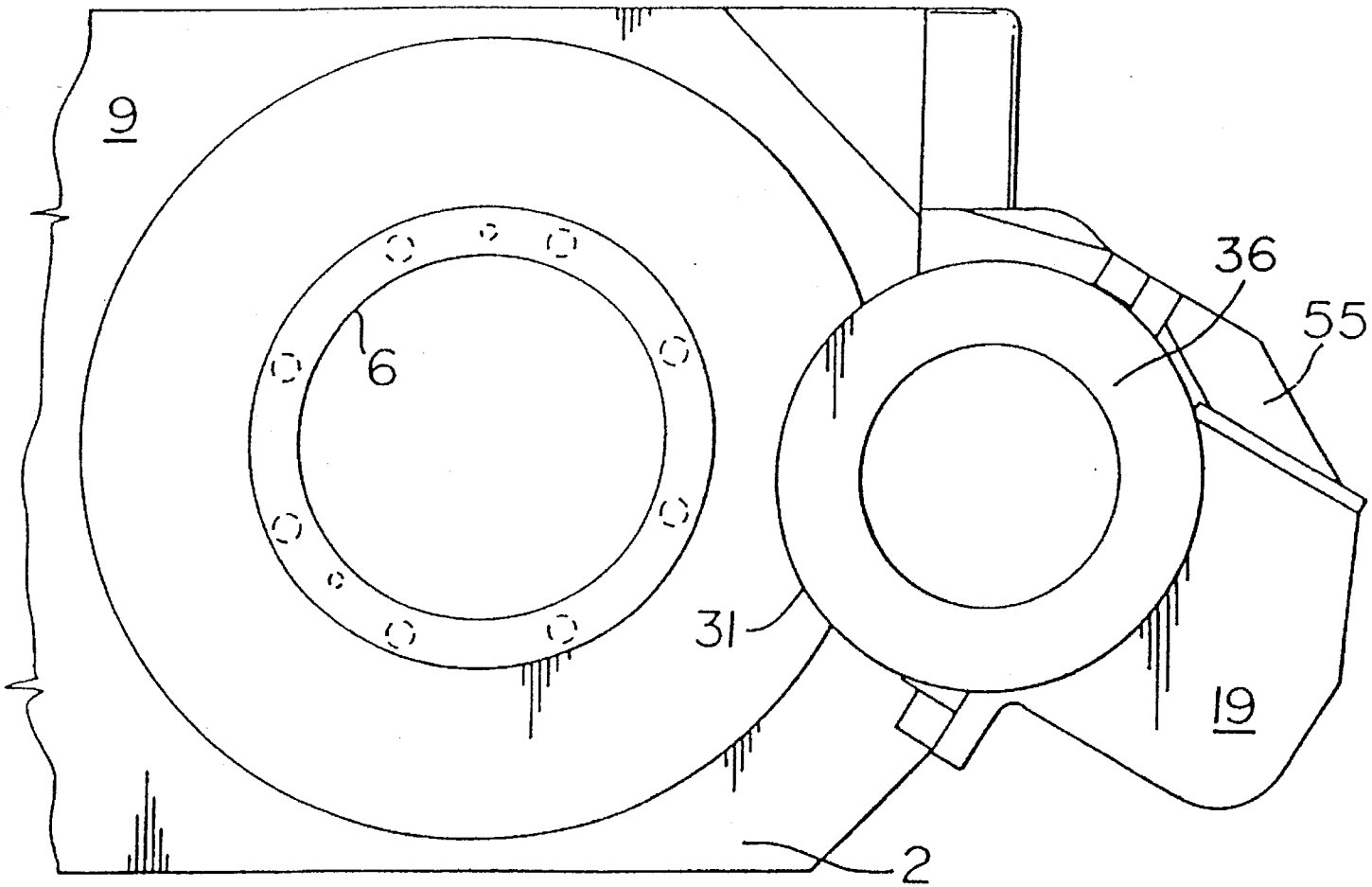
FIG. 12 is an end view of the modified traction motor housing and shaft suspension system as viewed from the left of FIG. 2.
Figure 13:
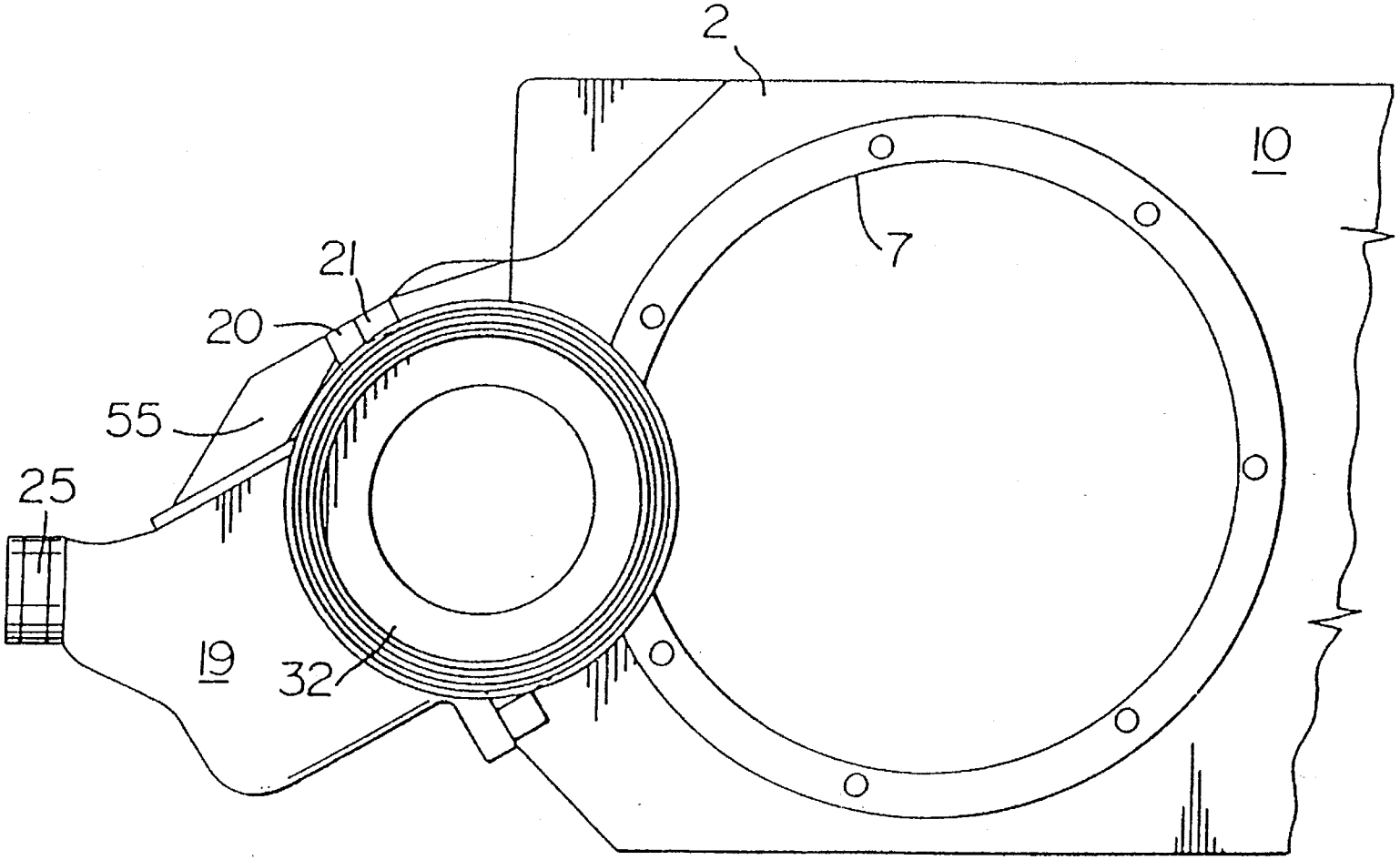
FIG. 13 is an end view of the modified traction motor housing and shaft suspension system as viewed from the right of FIG. 2, with parts omitted.

The modification is completed by a generally U-shaped cover 48 which is welded at one end 49 to one oil cap 19. The cover 48 extends around the shaft 26 to protect the latter. A semicircular flange 50 is provided on the other end of the cover 48. A plurality of holes 52 are provided in the flange 50 for receiving bolts 53 (FIG. 11) which connect the flange to the flange 20. Shims (not shown) having generally the same shape as the flange 50, and holes for alignment with the holes in the flange are used to adjust the length of the cover, i.e. to adjust the length of the bearing support assembly. Thus, there is no looseness in the two bearings. Gussets 55 are normally provided on the sides of the bearing caps 19. Additional reinforcing gussets 56 (FIG. 5) are added to the motor housing 2.

The embodiments of the invention in which an exclusive property or privilege is claimed are defined as follows:

1. A method of converting a locomotive traction motor sleeve-type bearing suspension system to a roller bearing system wherein the sleeve-type bearing system includes bearing caps covering sleeve bearings mounted in a traction motor housing and rotatably supporting a conventional wheel axle, the method comprising the steps of:

(a) removing the sleeve bearings, bearing caps and the conventional wheel axle;

(b) forming recesses in the bearing caps and in the traction motor housing proximate the ends of the traction motor, said recesses for receiving roller bearing housings at each end of said traction motor housing;

(c) providing a replacement axle, installing the roller bearing housings and replacing the bearing caps having the recesses formed therein, so that the roller bearing housings are received in said recesses;

(d) mounting a generally U-shaped cover between said bearing housings, said U-shaped cover and said bearing caps at least partially surrounding the central portion of the replacement axle; and (e) connecting said roller bearing system to said traction motor housing.

2. A method according to claim 1, including the step of installing grease tubes in said bearing caps for feeding grease to said roller bearing housings.

3. A method according to claim 1, including the step of installing shims between said cover and one said rollerbearing housing for adjusting the length of said cover.

4. The method according to claim 1 wherein said roller bearing system comprises the replacement axle, the bearing caps having the recesses formed therein, and the roller bearing housings.

5. The method according to claim 1 wherein said conventional wheel axle has at least one seat and said replacement axle has at least one seat different for said at least one seat of said conventional wheel axle.

* * * * *